US006091920A

United States Patent [19]

Kita et al.

[11] Patent Number: 6,091,920

[45] Date of Patent: Jul. 18, 2000

[54] CYLINDRICAL TONER CONTAINER HAVING A TONER PORT AND A MOVABLE LID FOR CLOSING THE TONER PORT

[75] Inventors: Nobuhiko Kita, Okazaki; Toshihide Taniguchi, Toyokawa, both of Japan

[73] Assignee: Minolta Co., Ltd., Osaka, Japan

[21] Appl. No.: 09/267,164

[22] Filed: Mar. 12, 1999

[30] Foreign Application Priority Data

Mar. 27, 1998 [JP] Japan ..... 10-081385

[51] Int. Cl.[7] ..... G03G 15/08

[52] U.S. Cl. ..... 399/262

[58] Field of Search ..... 399/258, 260, 399/262, 263, 106; 222/167, 169, 172, 517, 556

[56] References Cited

U.S. PATENT DOCUMENTS

| | | | |
|---|---|---|---|
| 4,478,512 | 10/1984 | Zoltner | 399/106 |
| 4,924,920 | 5/1990 | Bhagwat | 141/98 |
| 5,030,997 | 7/1991 | Michlin et al. | 399/106 |
| 5,260,750 | 11/1993 | Ishida et al. | 399/262 |
| 5,307,129 | 4/1994 | Miura et al. | 399/263 |
| 5,515,143 | 5/1996 | Shiotani | 399/106 |
| 5,822,653 | 10/1998 | Ishii | 399/104 |
| 5,867,757 | 2/1999 | Okazaki et al. | 399/262 |

FOREIGN PATENT DOCUMENTS 10020669 1/1998 Japan .

*Primary Examiner*—Robert Beatty
*Attorney, Agent, or Firm*—McDermott, Will & Emery

[57] ABSTRACT

A toner container has a rotatable cylindrical member attached to an opening portion of a recessed side wall of the toner container. A portion of the outer periphery of the cylindrical member includes a toner port so that toner particles contained in the toner container can be fed through the toner port to a developer. The cylindrical member is rotatable from a position where the toner port is at the bottom of the cylindrical member to a position where the toner port is at the top of the cylindrical member under a lid member which covers the toner port to completely prevent the leakage of toner particles from the toner container during the exchange or transportation of the toner container.

20 Claims, 14 Drawing Sheets

CYLINDRICAL TONER CONTAINER HAVING A TONER PORT AND A MOVABLE LID FOR CLOSING THE TONER PORT

CROSS-REFERENCES TO RELATED APPLICATIONS

This application is based on application No. 10-081385 filed Mar. 27, 1998, in Japan, the content of which is hereby incorporated by reference.

BACKGROUND OF THE INVENTION

1. Field of the Invention

The present invention relates to a toner container for supplying toner particles to a developer, which is disposed in a copying machine, a printer or the like, as well as to a technique for preventing the leakage of toner particles from a toner outlet of the toner container.

2. Description of the Background Art

In a copying machine, a printer, etc., for example, an electrostatic latent image is created on a surface of a photosensitive drum and a developer apparatus develops the electrostatic latent image so that a toner image is created.

In general, a developer apparatus comprises a developer apparatus main body for supplying toner particles to a photosensitive drum through a developer roller and a toner container for providing the developer apparatus main body with the toner particles. The toner container is detachable from the developer apparatus main body for easy exchange with another toner container, even by ordinary users.

FIG. 15(*a*) is a perspective appearance view showing an example of a conventional toner container.

A conventional toner container comprises a toner housing portion 901 for internally housing toner particles, a cylindrical member 902, which projects from one side surface of the toner housing portion, and a cylindrical shutter member 903, which is attached for free rotation in the circumferential direction relative to the cylindrical member 902. Internally, the toner housing portion comprises a feeding screw (not shown) for feeding toner particles toward the cylindrical member 902, and a discharge outlet 9021 for discharging to the outside the toner particles fed into the cylindrical member 902 from the toner housing portion 901. (See FIG. 15(*b*).) The discharge outlet 9021 is disposed approximately in a central lower portion, in the axial direction, of the outer peripheral surface of the cylindrical member 902. An opening portion 904, which is somewhat larger than the discharge outlet 9021, is formed in the shutter member 903, at a position that approximately matches the discharge outlet 9021 in the axial direction.

FIG. 15(*b*) is a cross sectional view of the cylindrical member 902 and the shutter member 903 of FIG. 15(*a*), taken along the line X—X. FIG. 15(*b*) shows a condition in which the shutter member 903 is rotated to position the opening portion 904 facing down. This is a condition in which the position of the discharge outlet 9021 of the cylindrical member 902 and the position of the opening portion 904 of the shutter member 903 match or coincide with each other so that the toner particles fed into the cylindrical member 902 drop and are supplied into the developer apparatus main body from the opening portion 904.

On the other hand, when the toner container is to re-filled, the shutter member 903 is rotated to displace or move the opening portion 904 from the position beneath the discharge outlet 9021 so that the inner peripheral surface of the shutter member 903 can block the discharge outlet 9021. At this stage, to prevent toner particles from leaking out from the opening portion 904, a seal member 905 of a highly compressive elastic material (e.g., foamed urethane) is adhered to the inner peripheral surface of the shutter member 903.

However, when the shutter member 903 is rotated to block the discharge outlet 9021, an end portion 9051 of the seal member 905 is snagged by an edge of the discharge outlet 9021, as shown in FIG. 15(*c*). Then, if the shutter member 903 is forced to rotate further, the seal member 905 is torn apart or chipped off at that portion, so that a gap is created between the shutter member 903 and the cylindrical member 902 and toner particles leak out from the gap.

A highly compressive member cannot be used in the conventional toner container because of this problem. The conventional toner container has the disadvantage of making it impossible to completely prevent leakage of toner particles during its re-filling.

In most cases involving a small printer and the like, which are in wide use, it is a user who has to replace the toner container in the printer. Hence, even a little leakage of toner particles from a gap between the shutter member 903 and the cylindrical member 902 blacken the user's hands and cloths used to clean the user's hands.

BRIEF SUMMARY OF THE INVENTION

The present invention has been made to solve the problems described above.

Accordingly, an object of the present invention is to provide a toner container attachable to and detachable from an image creating apparatus, such as a printer, which toner container has a mechanism for blocking a toner discharge hole with a shutter and for completely preventing leakage of toner particles during the exchange or transportation of the toner container. Also, an object of the present invention is to provide an image creating apparatus that uses such a toner container.

To achieve these objects, a toner container is characterized in that a cylindrical member whose outer periphery portion includes a toner outlet is attached for free rotation to an opening portion of a toner container main body so that toner particles contained in the toner container main body are supplied through the toner outlet of the cylindrical member, and in that the toner container comprises a lid member that covers the toner outlet as the cylindrical member rotates.

Further, the toner container is characterized in further comprising: guiding means for guiding the lid member from a first position at which a surface of the lid member, which faces with the toner outlet of the cylindrical member, is off the outlet to a second position at which the faced surface abuts and blocks the outlet; and transmitting means for converting circumferential movement of the cylindrical member associated with the rotation of the cylindrical member into a direction of movement from the first position to the second position and for transmitting movement to the lid member.

Further, the toner container is characterized in that the top/bottom direction of the toner container is specified in such a manner that the toner outlet of the cylindrical member is directed downward during the supply of the toner particles thereto and that the lid member blocks the outlet when the toner container is rotated and the toner outlet is directed upward.

Further, the toner container is characterized in that at least the surface of the lid member that faces the outlet is formed by an elastic material.

Further, the toner container is characterized in that a side surface of the toner container is partially recessed, an opening portion is formed in the recessed surface, and the cylindrical member is mounted for free rotation to this opening portion.

Further, the toner container is characterized in that the toner container comprises first and second rotating feed members, whose rotation axes are disposed approximately parallel to each other within the toner container, the rotation axis of the first rotating feed member is arranged approximately coaxial with the center of rotation of the cylindrical member so that the first rotating feed member feeds the toner particles toward the outlet when driven, and the second rotating feed member when driven feeds in a different direction from the feeding direction by means of the first feed member at least in a portion of the axial direction.

Further, the toner container is characterized in that the second rotating feed member is formed with a plurality of blade chains, which are each formed by arranging a plurality of film-like blades in the longitudinal direction of the second rotating feed member, disposed around the axis of the second rotating feed member, and with respect to at least adjacent ones of the blade chains, the positions of blade ends in the axial direction are different from each other.

Further, an image creating apparatus, which develops with toner particles contained in a developer to thereby create an image on an image holder, is characterized in using the toner container according to the present invention as a toner container for supplying the toner particles to the developer. The image holder refers to a photosensitive medium, an intermediate transfer medium or the like used in an electrophotographic image creating apparatus, and even a transfer medium used in an image creating apparatus which supplies toner particles directly to a transfer medium, e.g., an image creating apparatus in which a plurality of recording electrodes are arranged on the back of a transfer medium and an electric field, which is developed by the recording electrodes transfers toner particles.

BRIEF DESCRIPTION OF THE SEVERAL VIEW OF THE DRAWINGS

FIG. 4(*b*) is a cross sectional view of the toner container taken along the line C—C in FIG. 3;

Figure 2:
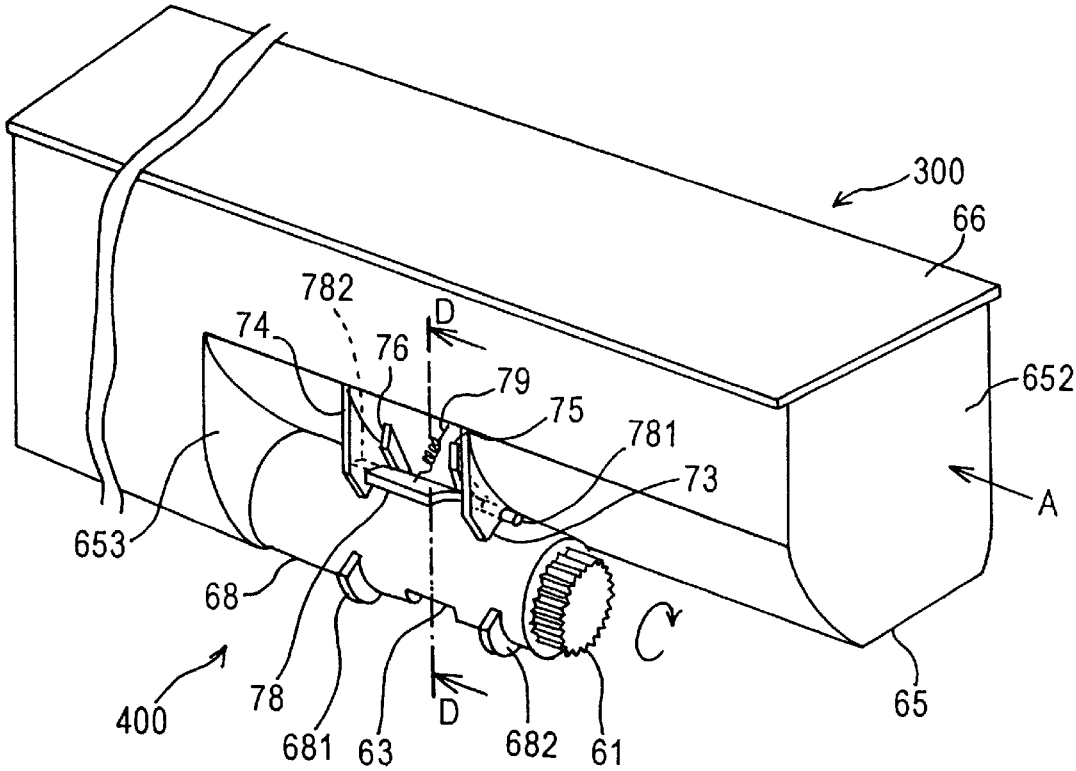
FIG. 2 is a perspective view showing the entire toner container.
Figure 6A:
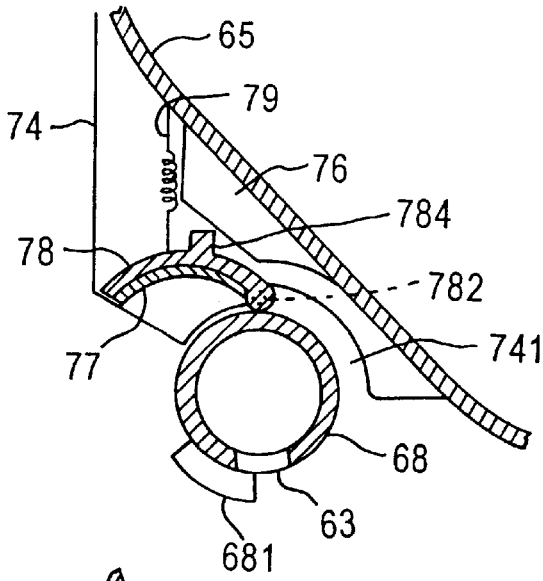
Figure 6B:
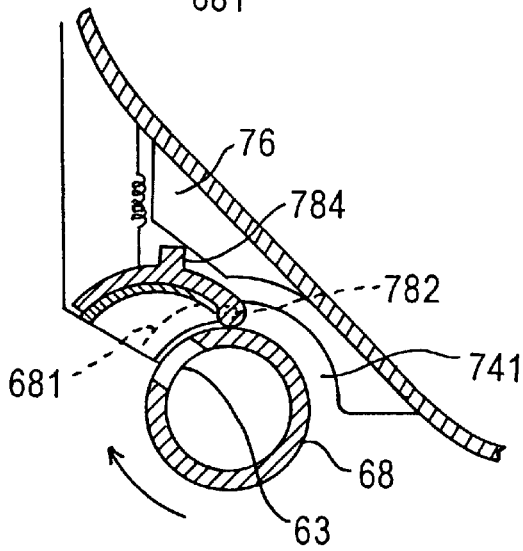
Figure 6C:
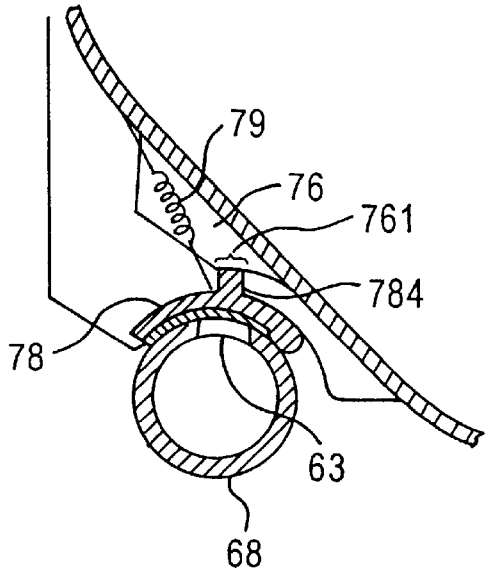
Figure 7:
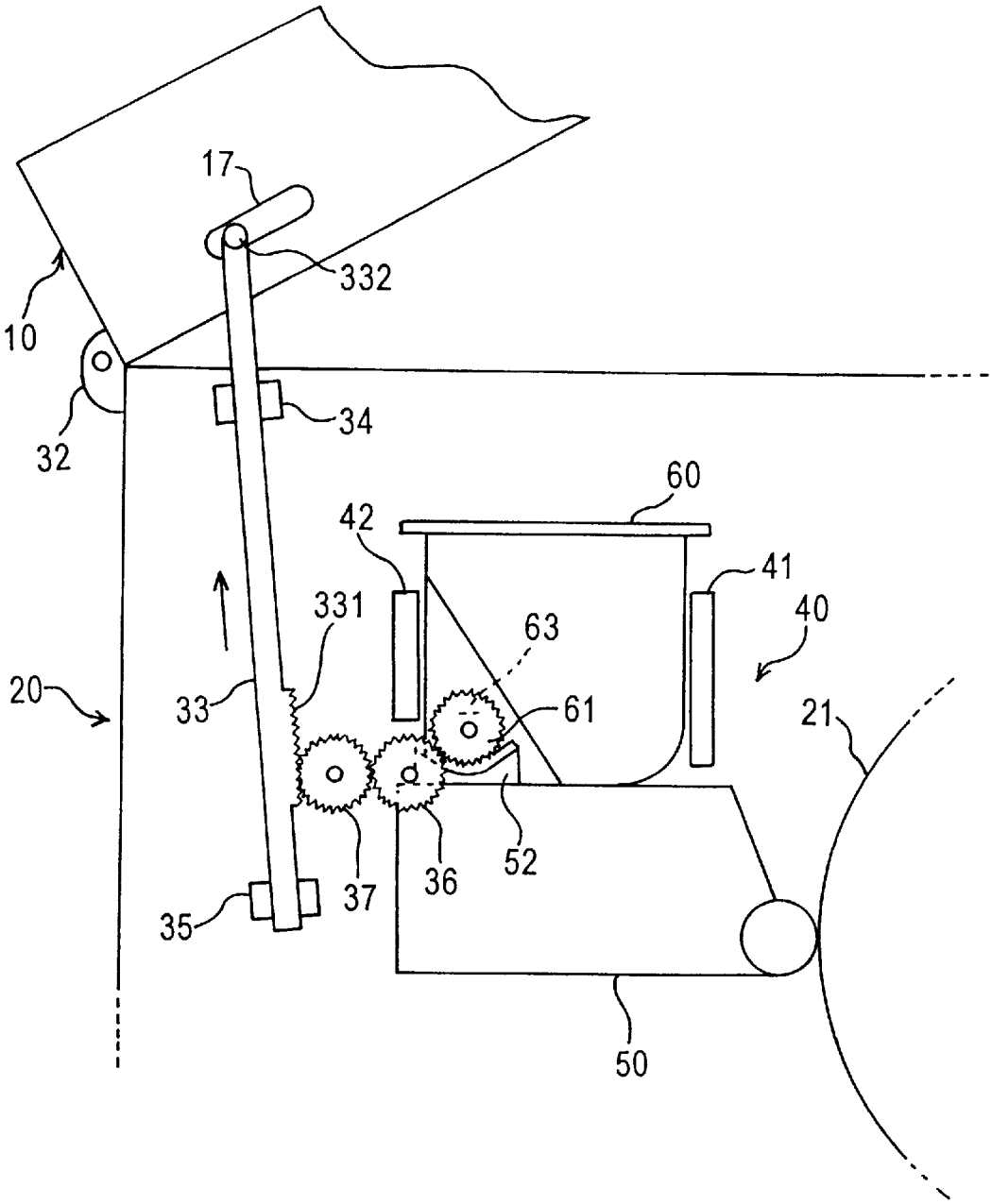
Figure 8:
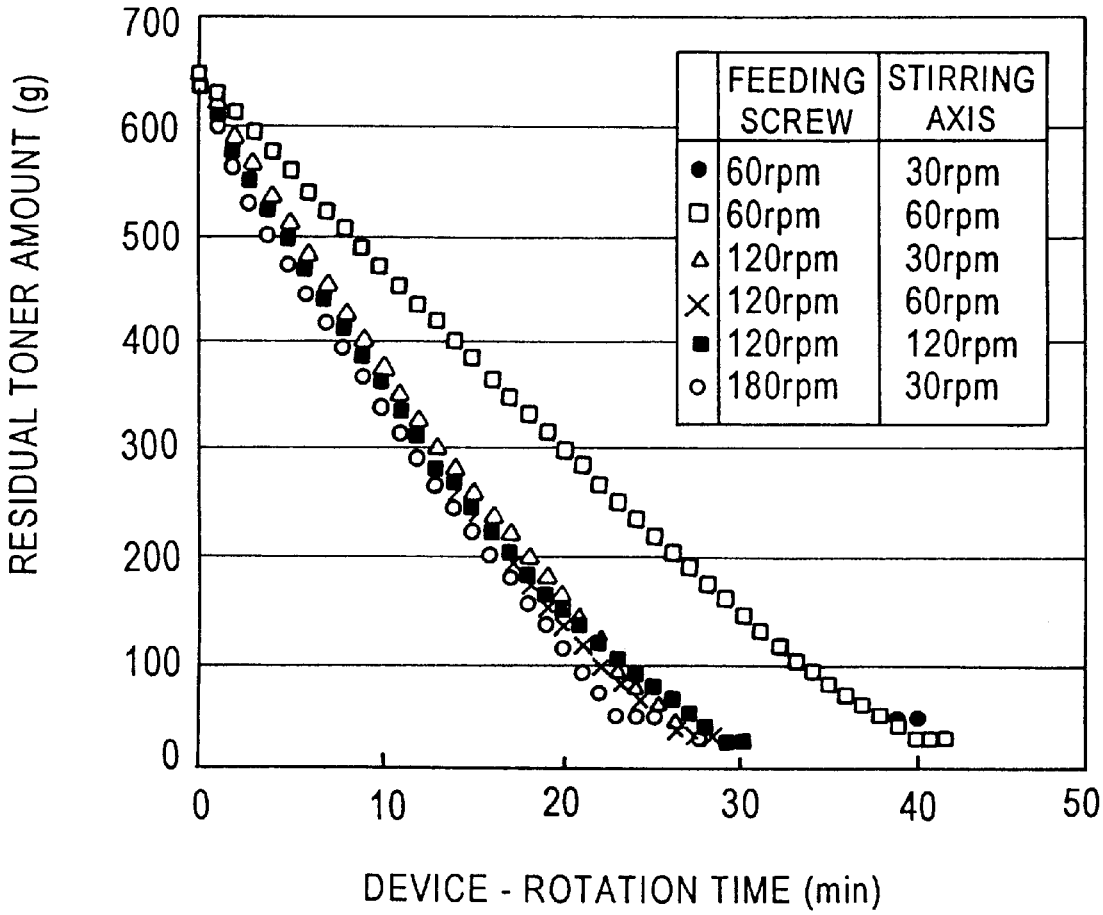
Figure 9:
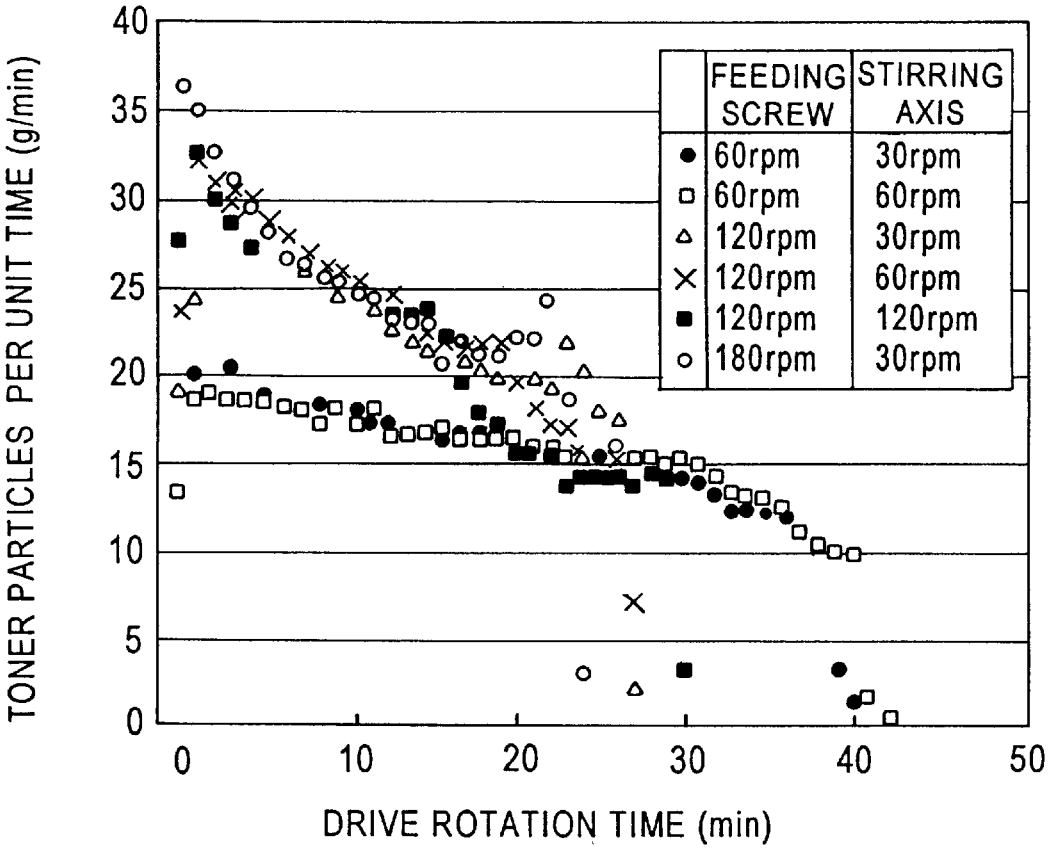
Figure 10A:
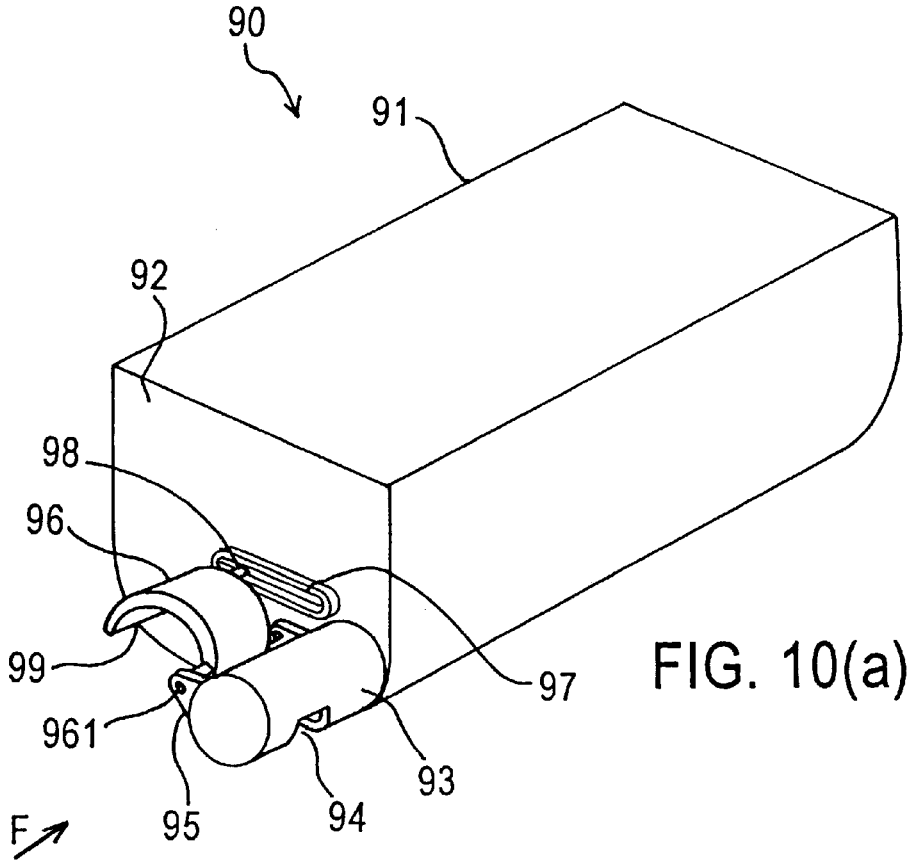
Figure 10B:
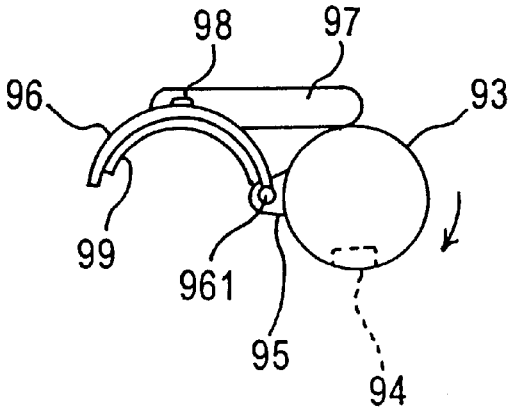
Figure 10C:
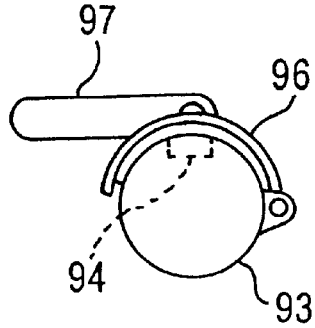
Figure 11:
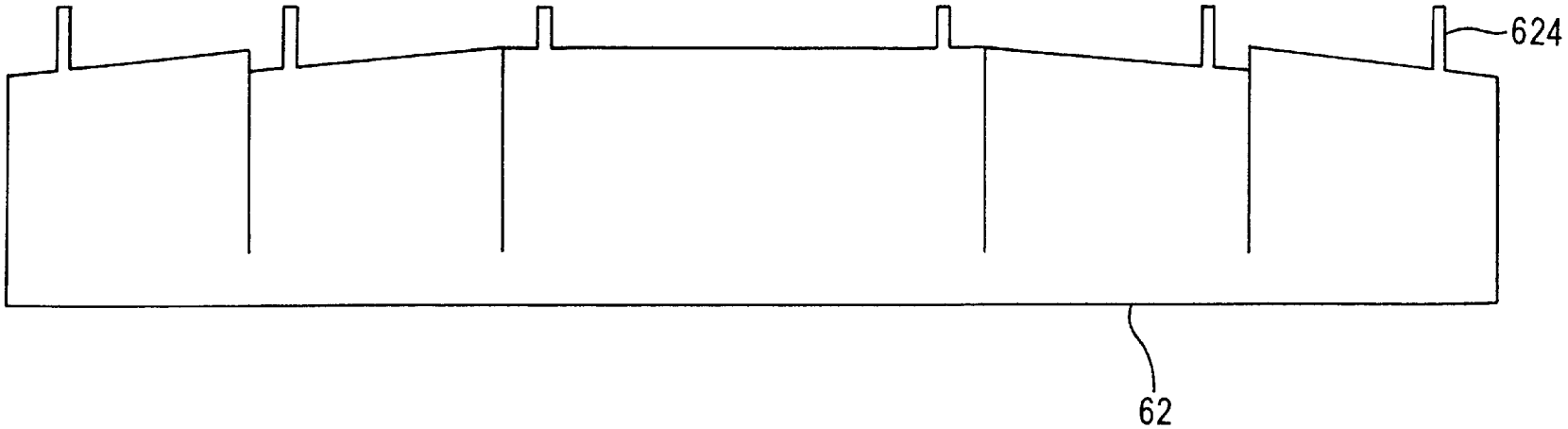
Figure 12:
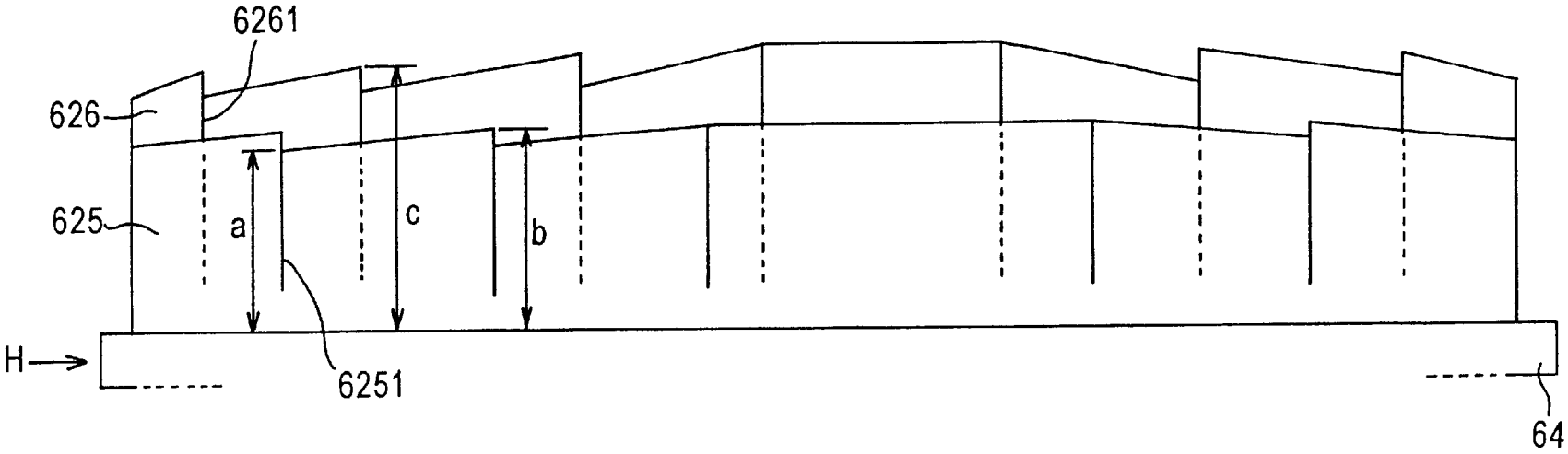
Figure 13:
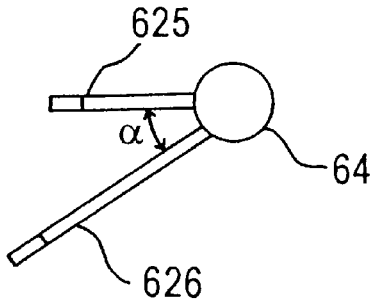
Figure 14A:
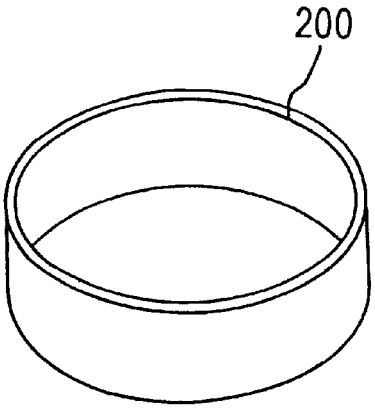
Figure 14B:
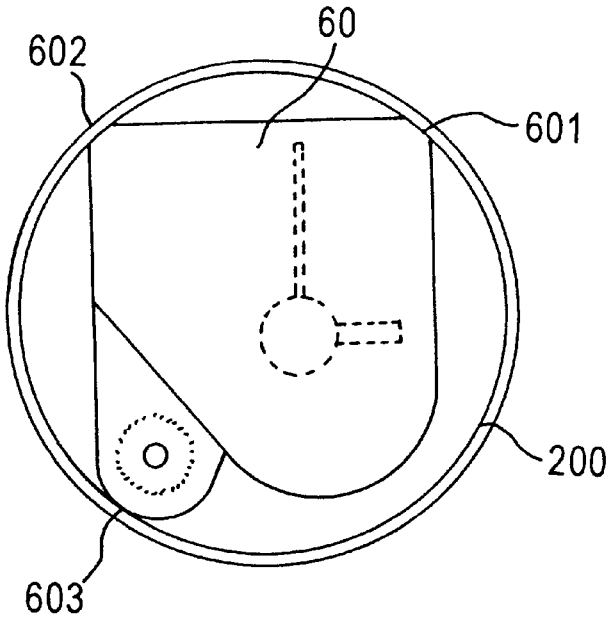
Figure 15A:
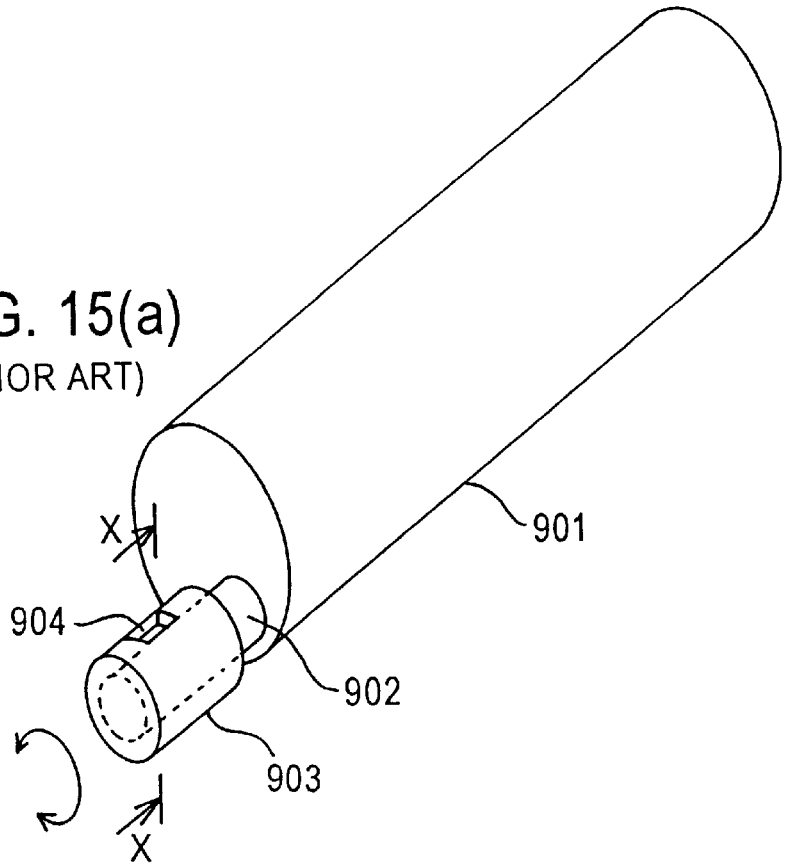
FIG. 15(a) (PRIOR ART)
Figure 15B:
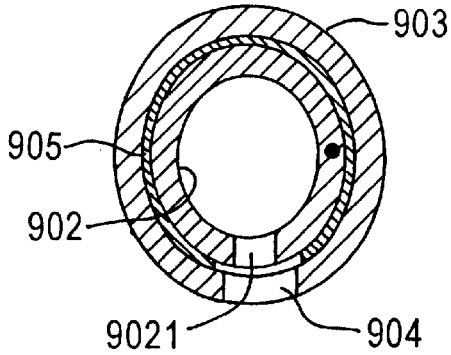
FIG. 15(b) (PRIOR ART)
Figure 15C:
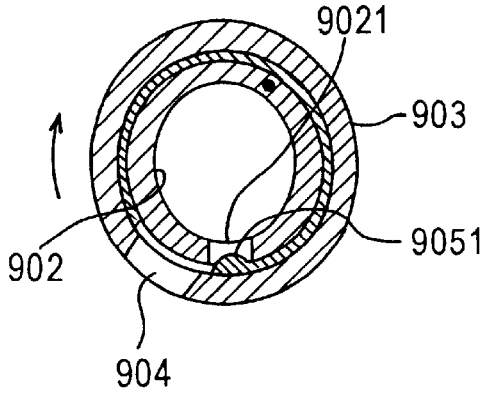
FIG. 15(c) (PRIOR ART)

FIGS. 6(*a*), 6(*b*) and 6(*c*) are cross sectional views of the toner outlet taken along the line D—D in FIG. 2, showing a shutter blocking a discharge hole as a cylindrical member rotates;

FIG. 7 is a diagram showing a mechanism for rotating the cylindrical member;

FIG. 8 is a view showing a graph whose coordinate axes are a horizontal axis measuring a drive-rotation time (min) for driving a feeding screw and a stirring axis and a vertical axis measuring a residual toner amount (g) in the toner container;

FIG. 9 is a view showing a graph whose coordinate axes are a horizontal axis measuring a drive-rotation time (min) for driving the feeding screw and the stirring axis and a vertical axis measuring a discharged amount of toner particles per unit time (g/min);

FIG. 10(*a*) is a perspective view showing another example of the toner container;

FIG. 10(*b*) is a diagram of the cylindrical member and the shutter as viewed from the direction of the arrow F in FIG. 10(*a*);

FIG. 10(*c*) is a diagram of the cylindrical member and the shutter as viewed from the direction of the arrow F in FIG. 10(*a*) with the cylindrical member having been rotated from its position shown in FIG. 10(*b*);

FIG. 11 is a diagram showing a stirring film that includes projections;

FIG. 12 is a plan view showing two stirring films attached to the stirring axis;

FIG. 13 is a side view of FIG. 12 as viewed from the direction of the arrow H;

FIG. 14(*a*) is a perspective view showing an appearance of a retainer;

FIG. 14(*b*) is a plan view of the retainer with the toner container set thereto;

FIG. 15(*a*) is a perspective view showing an appearance a portion of a conventional toner container; and FIGS. 15(*b*) and 15(*c*) are cross sectional views of FIG. 15(*a*) taken along the line X—X.

DETAILED DESCRIPTION OF THE INVENTION

In the following, preferred embodiments of a toner container according to the present invention will be described in relation to a printer.

(1) Overall Structure of Printer

First, an overall structure of a printer 1 will be described with reference to FIG. 1.

Figure 1:
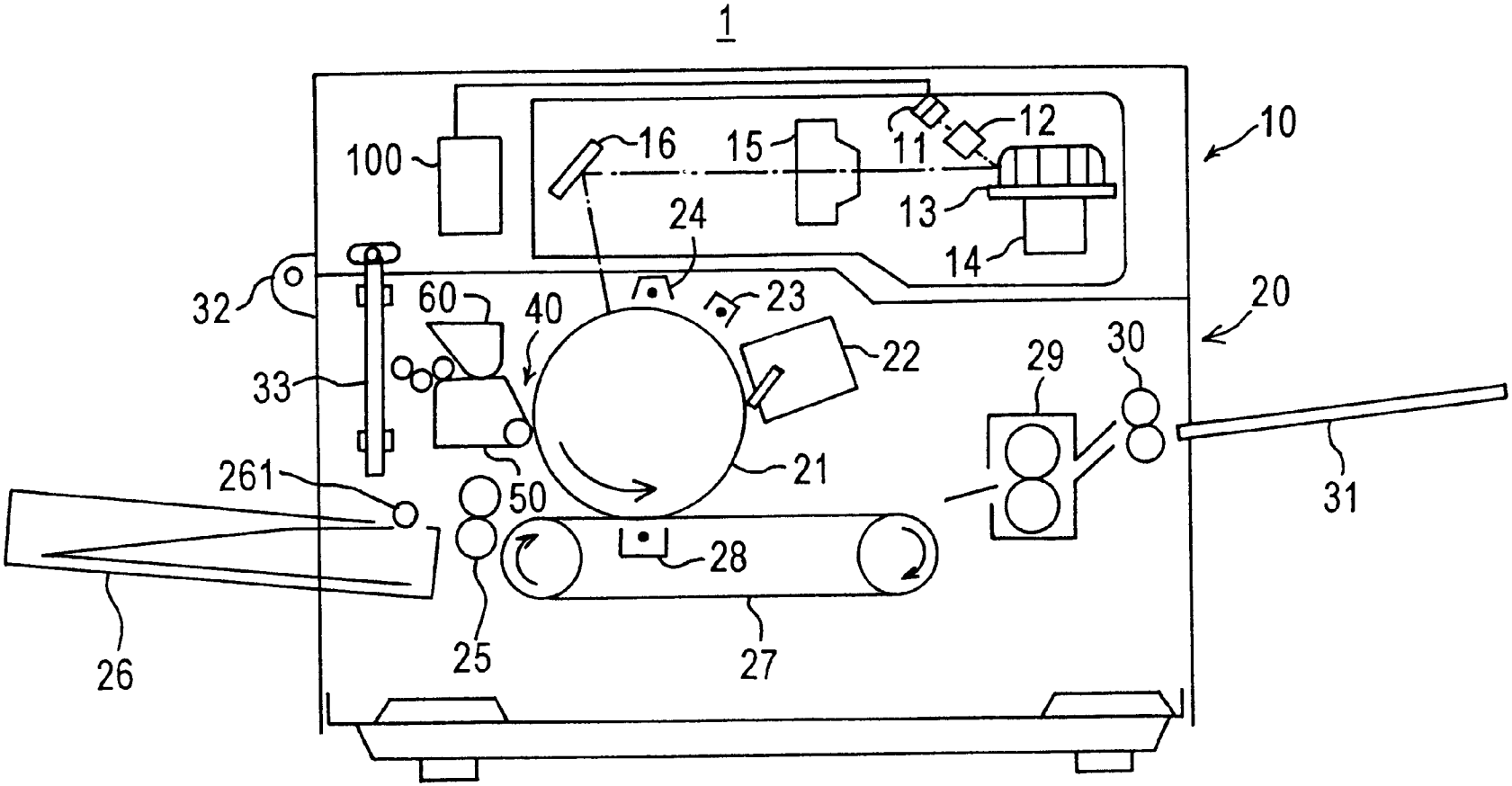
FIG. 1 is a diagram showing an overall structure of a printer to which a toner container according to the present invention is applied.

As shown in FIG. 1, the printer 1 creates an image by a conventional electrophotographic method, and is divided generally into an expose/scan portion 10 and an image creating portion 20.

The printer 1 is connected to an external computer or the like (not shown). A control portion 100, upon receipt of an image signal, which is fed from the external computer, performs necessary processing on the image signal to create image data and outputs a drive signal to a laser diode 11 of the expose/scan portion 10.

Receiving the drive signal from the control portion 100, the laser diode 11 emits laser light. The laser light passes through a collimate lens 12 to become parallel light, and is thereafter reflected and deflected by a mirror surface of a polygon mirror 13, which rotates at a constant speed when driven by a polygon motor 14.

The deflected laser light passes through an fθ lens 15 and is then reflected by a return mirror 16 to thereby scan and accordingly expose a surface of a photosensitive drum 21.

The photosensitive drum 21 of the image creating portion 20 is cleaned off by a cleaner 22 of residual toner particles, which remain on a photosensitive surface, before the exposure described above. Further, after irradiated with and accordingly diselectrified by an erase lamp 23, the photosensitive drum 21 is uniformly electrified by an electrify charger 24. When the photosensitive drum 21 is exposed as it is uniformly electrified in this manner, an electrostatic latent image is formed on the photosensitive medium on the surface of the photosensitive drum 21.

The electrostatic latent image is developed by a developer apparatus 40, whereby a toner image is formed on the surface of the photosensitive drum 21.

The developer apparatus 40 comprises a developer 50, which comprises a developer roller, a stirring apparatus and the like, and a toner container 60, which is set to a top portion of the developer 50 so as to supply toner particles into the developer 50 when necessary. The toner container 60 is detachable or removable from the image creating portion 20 so that it is easy for even a user to exchange or replace the toner container 60.

In synchronization with the rotation of the photosensitive drum 21, a transfer paper (not shown), which is set to a paper cassette 26, is fed forward by a paper feeding roller 261, a timing roller pair 25 and a conveyer belt 27 to a transfer position, which is below the photosensitive drum 21. At the transfer position, by means of electric charges of a transfer charger 28, which is disposed on the back surface side of the conveyer belt 27, the toner image, which is formed on the surface of the photosensitive drum 21, is transferred onto the transfer paper.

Since the toner image, which is transferred onto the transfer paper, is unstable and easy to fall off, the transfer paper is transported by the conveyer belt 27 to a fixing apparatus 29. After being pressurized at a high temperature and accordingly fixed, the transfer paper is discharged by a pair of discharge rollers 30 to a paper discharge tray 31.

The expose/scan portion 10 is structured to be raised or opened around a hinge 32, which serves as a fulcrum, thereby allowing work to be performed on the image creating portion 20, such as exchanging of the toner container 60 with another toner container, removal of a jammed paper within the printer 1, etc.

(2) Structure of Toner Container 60

FIG. 2 is a perspective appearance view of the toner container 60.

As shown in FIG. 2, the toner container 60 comprises a toner housing portion 300 and a toner drawing portion 400 for supplying toner particles, which are contained within the toner housing 300, to the developer 50.

In the toner housing portion 300, a portion 653 of the right side surface 652 is partially recessed inward. A cylindrical member 68, whose outer periphery portion includes a toner discharge hole 63, is disposed for free rotation on such a recessed surface 653. The cylindrical member 68 defines the toner drawing portion 400.

Figure 3:
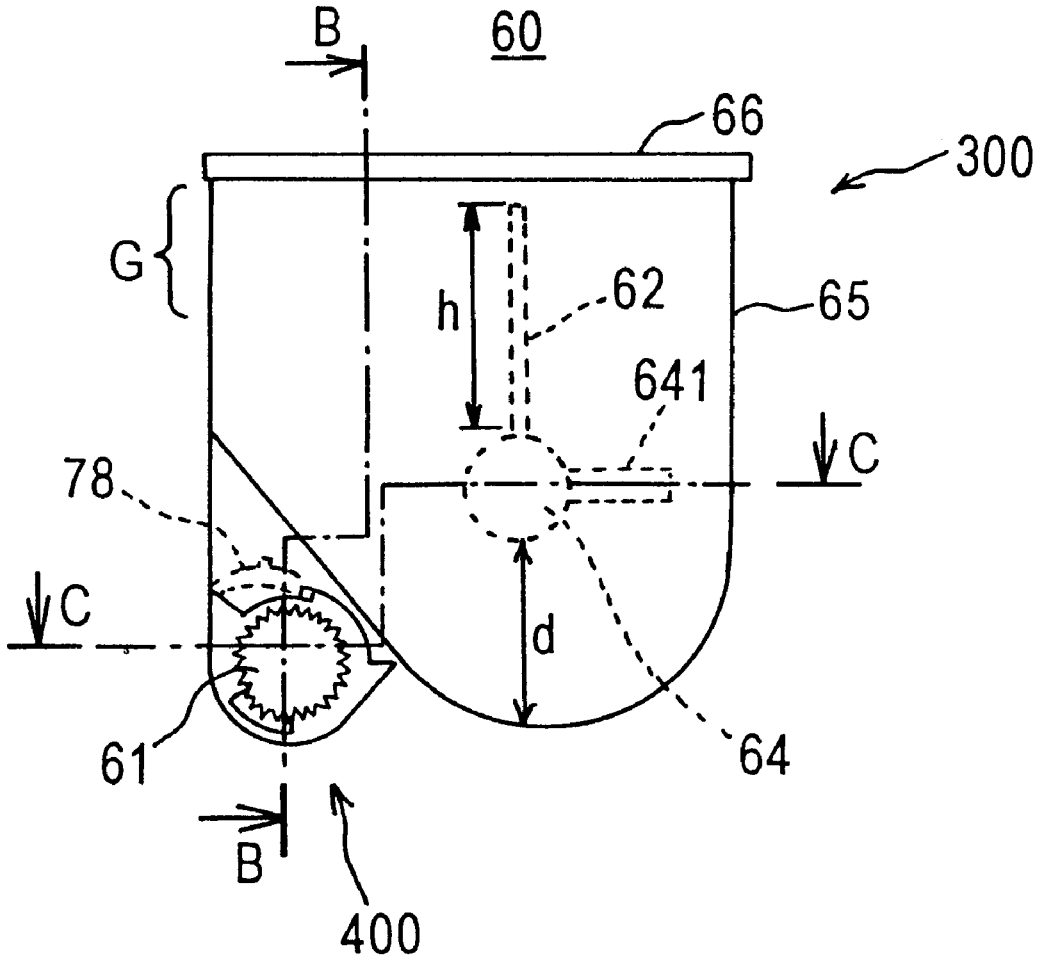
FIG. 3 is a side view of the toner container as viewed from the direction A in FIG. 2.

FIG. 3 is a side view of the toner container 60 as viewed from the direction A in FIG. 2.

In the toner housing portion 300, a stirring mechanism, such as a stirring film 62 and a stirring rod 641, is disposed within a hollow container 65 whose top is open. The opening portion of the hollow container 65 is sealed off with a lid member 66.

Figures 4A, 4B:
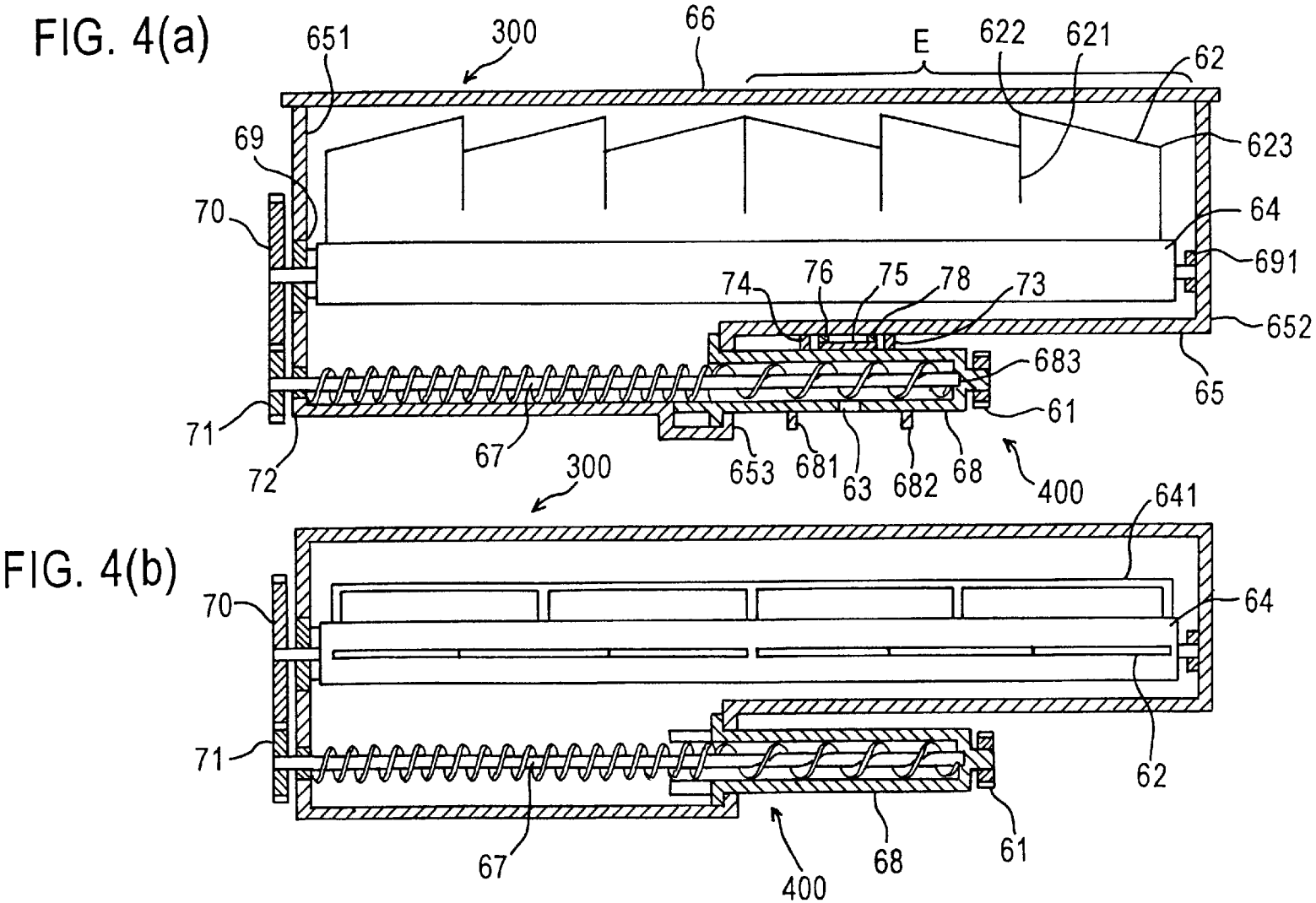
FIG. 4(*a*) is a cross sectional view of the toner container taken along the line B—B in FIG. 3.

FIG. 4(*a*) is a cross sectional view of the toner container 60 taken along the line B—B in FIG. 3, while FIG. 4(*b*) is a cross sectional view of the toner container taken along the line C—C in FIG. 3.

As shown in FIGS. 4(*a*) and 4(*b*), the hollow container of the toner housing portion 300 houses a stirring axis 64, which is axially supported for free rotation by bearing members 69 and 691, which are disposed to a left side surface 651 and a right side surface 652, respectively. One end of the stirring axis 64 projects out penetrating the left side surface 651. An input gear 70 is mounted on the projecting end.

The stirring film 62, which has approximately the same length as the axial length of the stirring axis 64, is attached to the stirring axis 64. The stirring film 62 is formed by a polyester film or the like. The stirring film 62 defines blades with slits (notches) 621 at the ends of six sections, which have approximately the same length with each other in the longitudinal direction. The length in the radial direction of each blade is progressively longer toward a direction in which toner particles are fed by the blades.

The length h (See FIG. 3) of the longer sides 622 of each blade of the stirring film 62 is longer than the length d to a bottom surface of the hollow container 65. Hence, as the stirring axis 64 rotates and the front end portions of the stirring film 62 reach the bottom surface of the hollow container 65, the stirring film 62 warps while rotating. At this stage, a warp along the longer sides 622 is larger than a warp along the shorter sides 623. As a result, toner particles at both ends within the hollow container 65 are gradually transported, while stirred up, toward the toner drawing portion 400, which is located at a central portion of the hollow container.

Figure 5:
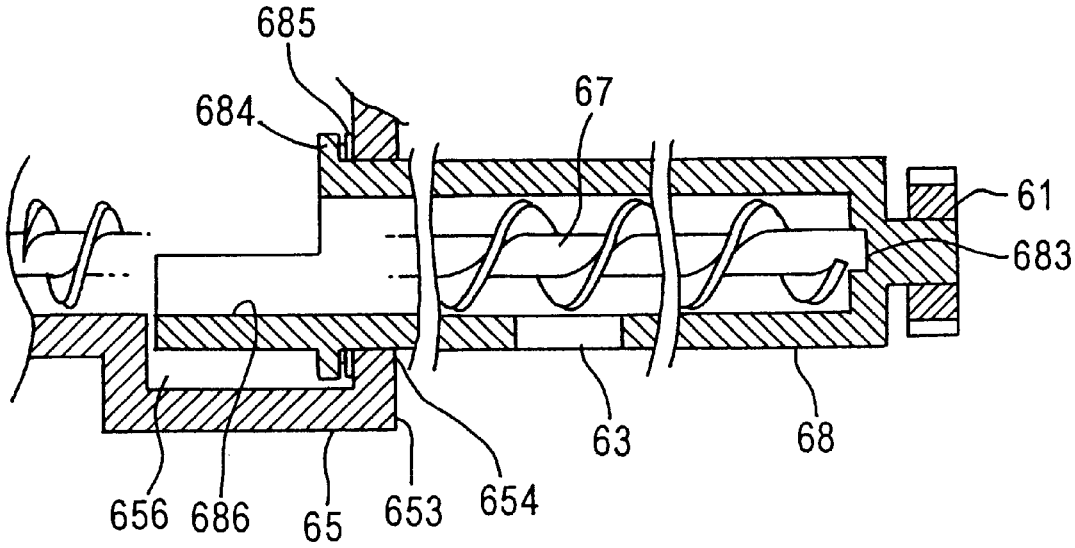
FIG. 5 is an enlarged view of a toner outlet of the toner container.

FIG. 5 is an enlarged view of the toner drawing portion 400. As shown in FIG. 5, a round opening portion 654, whose diameter is approximately the same as the outer diameter of the cylindrical member 68, is formed in the recessed surface 653 of the hollow container 65. The cylindrical member 68 is inserted from inside the hollow container 65 and mounted in the opening portion 654. During the insertion, to prevent toner particles from leaking out from a gap between the opening portion 654 and the cylindrical member 68, a V-shaped ring packing 685 is interposed as a seal member between a brim portion 684 of the cylindrical member 68 and inside the opening portion 654.

As described later, a gear 61 for rotating the cylindrical member 68, in association with an opening/closing operation of the expose/scan portion 10, is fixed to a front end portion of the cylindrical member 68. A spiral feeding screw 67 for feeding toner particles into the cylindrical member 68 is disposed on the cylindrical member 68 at the center line of rotation. The axis of the feeding screw 67 is supported at one end by a recessed portion 683, which is formed in the side surface of the cylindrical member 68. As shown in FIG. 4(*a*), the other end of the feeding screw 67 is supported by a bearing member 72, which is disposed in the left side surface 651, and a feeding gear 71 is mounted on a projecting end of the feeding screw 67.

The pitch of the feeding screw 67 described above becomes larger within the hollow container 65 than in the cylindrical member 68. This allows the toner particles to be fed and discharged at a faster speed within the cylindrical member 68 than in the hollow container 65, and therefore, as compared with a case where the pitch of the feeding screw 67 remains the same, a fewer amount of toner particles remain inside the cylindrical member 68. It is not necessary that the pitch of the feeding screw 67 stays large within the entire the cylindrical member 68. Instead, the pitch of the feeding screw 67 only needs be large at least in the vicinity of the toner discharge hole 63, so to make it possible to reduce residual toner particles.

Further, as shown in FIG. 5, a recessed portion 656 is formed in the hollow container 65 so that a lower end portion of the brim portion 684 of the cylindrical member 68 does not abut the hollow container 65. In addition, to prevent transported toner particles from entering the recessed portion 656, a receiving portion 686, which has a semi-arch shape in a cross section is disposed extending approximately the same length as the recessed portion 656 along the axial direction of the cylindrical member 68. This prevents toner particles, which are on the bottom surface of the hollow container 65, from entering the recessed portion 656, and consequently, ensures that the toner particles are smoothly fed in the cylindrical member 68.

It is desirable that the gear 61, in diameter, does not project beyond the bottom-most surface of the toner container 60. This is because in the case that a user places the toner container 60 on a table or the like in an effort to manipulate the toner container 60, any portion of the gear 61 protruding beyond the bottom-most surface may damage a toothed surface of the gear 61.

As described above, the cylindrical member 68 of the toner drawing portion 400 is disposed in the recessed surface 653 and toner particles, which are in a portion E of the toner housing portion 300, which corresponds to the toner drawing portion 400 (See FIG. 4(*a*)), are set out by the stirring film 62 into the toner drawing portion 400. As a result, even in a case that it is not possible to place the toner drawing portion 400 inside the printer 1 due to some design constraint, it is possible to contain toner particles in a portion that corresponds to the drawing portion, thereby allowing the toner container 60 to have a larger capacity considering an effective utilization of the space within the printer 1.

Further, since the stirring film 62 sends out toner particles as the stirring film 62 warps against the bottom surface of the hollow container 65, the quantity of toner particles remaining on the bottom surface is reduced. Still further, unlike in a case wherein toner particles are fed using a conventionally used spiral screw, it is not necessary that the shape of the bottom surface of the hollow container 65 is a perfect circle. This increases the freedom of shaping of the bottom surface of the hollow container 65, and hence, the volume of toner particles that can be contained in the hollow container.

The stirring axis 64 also seats a toner stirring rod 641, which is approximately at 90 degrees with respect to the stirring film 62 in the circumferential direction. The toner stirring rod 641 is for crushing hardened toner particles.

The input gear 70 is mounted to the stirring axis 64 as the toner container 60 is set at a predetermined position above the developer 50. The input gear 70 engages teeth (not shown) that are linked to a driving shaft of an electric motor of the apparatus main body, and are accordingly driven.

The control portion 100 receives a detect signal from a concentration sensor (not shown) at all the times to detect the concentration of a developer agent that is housed within the developer 50. Upon detection of a drop of a toner concentration from a predetermined concentration, the control portion 100 activates the electric motor and rotates the input gear 70. This causes toner particles inside the hollow container 65 to be fed in the cylindrical member 68, discharged through the toner discharge hole 63 and supplied into the developer 50.

Next, the structure of an open/close mechanism in the toner drawing portion 400 will be described.

As shown in the perspective view in FIG. 2, hooks 681 and 682 are attached to the outer peripheral surface of the cylindrical member 68, so as to protrude at positions that are opposed to each other with the toner discharge hole 63 in the middle between the hooks.

A shutter or lid 78, which is for blocking the toner discharge hole 63, is a semi-arch like thin plate whose inner diameter is approximately the same as the outer diameter of the cylindrical member 68. At the far end of the shutter 78, engage pins 781 and 782 are disposed in the direction that is parallel to the center of rotation of the cylindrical member 68. One pin 781 protrudes from one face of the shutter 78, while the other pin 782 protrudes from the opposite face of the shutter 78. Further, a projection 784 (See FIG. 6(*a*)) is formed on the top surface of the shutter 78, while a highly compressive sheet-like seal member (See FIG. 6(*a*)) of foamed urethane is attached to almost the entire bottom surface of the shutter 78.

Guides 73 and 74, which are for guiding the movement of the shutter 78, are formed on the surface of the hollow container 65 facing the cylindrical member 68. The guides 73 and 74 are in contact with a portion of the engage pins 781 and 782, respectively, which portion extends from the shutter 78. Further, ribs 75 and 76 are formed upright between the guides 73 and 74 on the surface of the hollow container 65 facing the cylindrical member 68.

FIGS. 6(*a*) through 6(*c*) are cross sectional views of the cylindrical member 68 taken along the line D—D in FIG. 2, showing the changes in the respective positions of the cylindrical member 68 and shutter 78, as the cylindrical member 68 rotates in a clockwise direction to move the shutter 78 to block the toner discharge hole 63.

The shutter 78 is always urged upward by an extension spring 79, whereby the projection 784 formed on the top surface of the shutter 78 abuts or contacts the rib 76. Another projection (not shown) is formed on the top surface of the shutter 78 to abut the other rib 75. Needless to mention, an elastic member of rubber or the like may be used instead of the extension spring 79.

The engage pins 781 and 782 are respectively fit in gaps 741 between the guides 73 and 74 and the cylindrical member 68, so as to be movable in the gaps 741 (other gap not shown) along the outer peripheral surface of the cylindrical member 68.

FIG. 6(*a*) shows the toner discharge hole 63 of the cylindrical member 68 in the down position, which is the same condition or position that is shown in FIG. 2. In this condition, as the cylindrical member 68 rotates in the clockwise direction, as shown in FIG. 6(*b*), the hook 681 abuts the engage pin 782, pushing along the outer peripheral surface of the cylindrical member 68. As this occurs, the projection 784, which is formed in the top portion of the shutter 78 abuts the rib 76, and therefore, the shutter 78 moves close to the toner discharge hole 63. At the same time, the other hook 682 abuts the engage pin 781 and the other projection (not shown) abuts the rib 75. When the cylindrical member 68 stops with the toner discharge hole 63 immediately above, as shown in FIG. 6(*c*), the shutter 78 covers the toner discharge hole 63.

As the shutter 78 covers the toner discharge hole 63, a seal member 77, which is stuck to the bottom surface of the shutter 78, is compressed by the force exerted by the ribs 75 and 76 via the projections 784 and (not shown), whereby a gap between the toner discharge hole 63 and the shutter 78 is blocked and toner particles are prevented from leaking out. Foamed urethane seals provide a tighter fit when compressed to about ½ through 1/10 as compared to their original thickness, which is effective in the prevention of leakage of toner particles.

As described above, the cylindrical member 68 rotates in a clockwise direction to reposition the toner discharge hole 63 from a bottom position to an upper position, and moves the shutter to the left and downward to covers the toner discharge hole 63. An advantage of the present invention is the prevention of the tearing off of the seal member 77 because the cylindrical member 68 rotates and blocks the toner discharge hole 63 rather than having a cover rotate to cover the discharge hole and rip the seal between the inside surface of the cover and the discharge hole. Moreover, the present invention provide for a tight fit over the discharge hole thereby avoiding the leakage of toner particles.

Immediately before the rotation of the cylindrical member 68 stops, the projection 784 of the shutter 78 slides under a bottom portion 761 of the rib 76. The inclination of the bottom portion 761 is approximately horizontal, and therefore, once the projection 784 gets under the bottom portion 761, the spring force of the extension spring 79 can not slide the shutter 78 back. This is to ensure that the shutter 78, when blocking the toner discharge hole 63, will not easily move.

While the foregoing has described a manner in which the shutter 78 blocks the toner discharge hole 63, when the shutter 78 moves away from the toner discharge hole 63, reverse operations, which are opposite to the above, are performed. During the opening of the toner discharge hole 63, as the cylindrical member 68 rotates in the anti-clockwise direction in FIG. 6(*c*), the shutter 78, which used to block the toner discharge hole 63, moves in the anti-clockwise or left direction because of the friction between the projection 784 of the shutter 78 with the cylindrical member 68, whereby the projection 784, which is formed in the top portion of the shutter 78, disengages from the bottom portion 761 of the rib 76 and the shutter 78 returns urged by the extension spring 79. The same occurs with the other projection (not shown) and the rib 76.

FIG. 7 is a diagram showing a mechanism for rotating the cylindrical member 68.

The gear 61, which is fixed to the front end portion of the cylindrical member 68, intermeshes with a toothed portion 331 of a rack 33 through gears 36 and 37, which are supported on the main body side of the printer 1. The rack 33 is held for free sliding, approximately in the vertical direction, by holding members 34 and 35, and a top end portion of the rack 33 that engages with a slide groove 17, which is formed in the expose/scan portion 10. With such a structure, when the expose/scan portion 10 is raised to provide access to the image creating portion 20, the rack 33 accordingly moves in the direction of the arrow, the gear 61 rotates approximately 189 degrees (semi-rotation) in the clockwise direction through the gears 37 and 36, whereby the toner discharge hole 63 moves approximately to a top position (the condition shown in FIG. 7).

On the other hand, when the expose/scan portion 10 is closed or lowered, the rack moves downward and the gear 61 semi-rotates in the anti-clockwise direction, thereby positioning the toner discharge hole 63 approximately to a bottom position.

By means of such a mechanism, it is possible to eliminate a cumbersome operation of rotating the cylindrical member 68 by hand.

In a portion of the developer 50, which faces the toner discharge hole 63, a semi-arch toner receiving portion 52 is disposed to receive toner particles, which fall from the toner discharge hole 63. Further, the toner container 60 is held by guides 41 and 42, which are disposed above the developer 50, so that if only the toner container 60 is lifted up, the toner container 60 can easily be removed and exchanged with another toner container.

Next, a result of an experiment will be described in which the toner container 60 according to the present invention was actually fabricated and the amount of toner particles discharged and the amount of residual toner remaining in the toner container 60 were measured while the feeding screw 67 and the stirring axis 64 were driven to rotate under a predetermined condition.

With respect to the toner container 60, the outer diameter of the feeding screw 67 is 13 mm, the pitch of the feeding screw 67 is 7.2 mm, the length h of the stirring film 62 (See FIG. 2) is 51 mm, and the distance from the peripheral surface of the stirring axis 64 to the bottom of the container (See FIG. 2) is 40 mm.

FIG. 8 is a graph in which a drive-rotation time (min) for driving the feeding screw 67 and the stirring axis 64 are measured along a horizontal axis and a residual toner amount (g) in the toner container 60 is measured along a vertical axis.

With combinations of the feeding screw 67 and the stirring axis 64 in terms of the number of revolutions, as those shown in the graph, the residual toner amount in the toner container 60 was measured for 50 minutes for each combination. Among points marked in the graph, up to 40 minutes, white squares and black circles are located approximately at the same positions, and therefore, only white squares are marked at those positions.

As clearly shown in FIG. 8, almost all toner particles were discharged in 30 minutes when the rotation speed of the feeding screw 67 was set to 120 rpm or higher, i.e., the discharged amount of toner particles per unit time was larger than that where the rotation speed of the feeding screw 67 was set to 60 rpm. Further, even when the rotation speed was set to 60 rpm, almost all toner particles were discharged in 40 minutes. It then follows that toner particles are discharged leaving almost none remaining within the toner container 60 whatever the number of revolutions may be, and hence that even in the case of the toner container 60 according to the present invention whose right side surface 652 is partially recessed, if the shape of the stirring film 62, the number of revolutions of the feeding screw 67 and the like are considered, it is possible to discharge toner particles reliably without leaving almost no toner particles remaining.

FIG. 9 is a graph in which a drive-rotation time (min) for driving the feeding screw 67 and the stirring axis 64 are measured along a horizontal axis and a discharged amount of toner particles per unit time (g/min) is measured along a vertical axis.

Combinations of the feeding screw 67 and the stirring axis 64 in terms of the number of revolutions and the measurement time are similar to those in the measurement of the residual toner amount shown in FIG. 8. FIG. 9 shows that a discharged amount of toner particles per unit time was approximately constant until 40 minutes from the start of the measurement when the rotation speed of the feeding screw 67 was set to 60 rpm (black circles and white squares) whereas a discharged amount was large immediately after the start of the measurement but decreased with time when the rotation speed of the feeding screw 67 was set to 120 rpm or higher. In other words, it is possible to discharge toner particles faster when the rotation speed of the feeding screw 67 is set to 120 rpm or higher than when the rotation speed is 60 rpm, however with a large fluctuation in the discharged amount per unit time. Such a fluctuation in the discharged amount per unit time serves as an obstacle to stable supply of toner particles, which is not desirable.

Hence, with respect to the toner container 60 according to the present invention, the feeding screw 67 and the stirring axis 64 are driven with the number of revolutions of the feeding screw 67 set to 60 rpm and the number of revolutions of the stirring axis 64 set to 30 or 60 rpm, thereby realizing a stable supply of toner particles.

(3) Modifications

The present invention of course is not limited to the preferred embodiment described above, and rather, may be modified in the following manner.

(3-1) Although the preferred embodiment described above requires that the cylindrical member 68, which has the toner discharge hole 63, is attached to the recessed surface 653 that is recessed from the right side surface 652 of the toner container 60, if there is additional space in the image creating apparatus for installment of a toner container, a cylindrical member may be attached directly to the side surface rather than to a recessed surface.

FIG. 10(*a*) is a perspective view showing a toner container 90 according to such a modification. The toner container 90 comprises a hollow container 91 for housing toner particles, a cylindrical member 93. which is attached for free rotation to a side surface 92 of the hollow container 91, and a semi-arch shutter 96 whose one end is linked to a protrusion 95, which is disposed in an outer peripheral surface of the cylindrical member 93. In a like manner, the opposite end of the shutter 96 is linked to another protrusion, which is disposed in an outer peripheral surface of the cylindrical member 93

A toner discharge hole 94 is formed in the outer peripheral surface of the cylindrical member 93. Further, an inner diameter of the shutter 96 is approximately the same as an outer diameter of the cylindrical member 93, and a slidable engage pin 98 extends from an edge portion of the shutter 96 along and in engagement with a guide groove 97, which is formed in the side surface 92 of the hollow container 91.

A seal member 99 of foamed urethane is adhered to almost the entire bottom surface of the shutter 96.

FIG. 10(*b*) is a front view of the cylindrical member 93 and the shutter 96 as viewed from the direction of the arrow F in FIG. 10(*a*).

As the cylindrical member 93 rotates in the clockwise direction (the direction of the arrow in FIG. 10(*b*)), the shutter 96 which is linked to the protrusion 95 moves toward the right in FIG. 10(*c*) in accordance with the rotation, covering the toner discharge hole 94 approximately from above. At this stage, the shutter 96, while held in the guide groove 97, compresses the seal member 99 and blocks the toner discharge hole 94. This eliminates a gap between the shutter 96 and the toner discharge hole 94, and hence, prevents leakage of toner particles.

Alternatively, a simple method using only the cylindrical member 93 and the shutter 96 may be used, which does not require to form the guide groove 97. In this case, a spring, which presses the shutter 96 downward is used so that when the shutter 96 covers the toner discharge hole 94 approximately from above, the seal member 99 is compressed and a predetermined effect is obtained.

(3-2) In the preferred embodiment described above, the cross sectional shape of the toner container 60 is close to a rectangle shape instead of a conventional circular shape in order to fill the toner container 60 as much toner particles as possible. Hence, if there are hardened toner particles adhering close to an inner top portion of the toner container 60 (G in FIG. 3), for example, which is out of reach of the front end portion of the stirring film 62, the hardened toner particles may continue to adhere and become residual toner particles. While the hardened toner particles may be scraped off with extended top ends of the stirring film 62, if top ends of the stirring film 62 are extended too long, a warp against the bottom surface of the container becomes excessively large, which reduces the power of feeding toner particles. To deal with this, the top ends may comprise a plurality of projections 624 that can scrape off toner particles that adhere to an internal surface of the container, as shown in FIG. 11. As the stirring axis 64 revolves, the projections 624 move to the top portion of the hollow container 65 and warp as if to jump when the contact with the inner peripheral surface is eliminated, and therefore, the resulting fine vibrations drop the toner particles adhering to a portion, which the stirring film 62 can not reach within the top portion of the hollow container 65, allow a full use of toner particles.

More than one stirring film 62 may be used. For example, a plurality of stirring films may be disposed axially around the stirring axis 64.

FIG. 12 is a plan view showing two stirring films axially attached to the stirring axis 64, and FIG. 13 is a side view of FIG. 12 as viewed from the direction of the arrow H.

A first stirring film 625 and a second stirring film 626 are approximately the same length with respect to each other along the axial direction of the stirring axis 64, but are different from each other in the lengths a, b and c in the radial direction of the stirring axis 64.

The radial-direction length a of a slit portion of the first stirring film 625 is smaller than the radial-direction length b, the radial-direction length c of the second stirring film 626 is larger than the radial-direction length b, and the thickness of the first stirring film 625 is larger than the thickness of the second stirring film 626. Slits 6251 and 6261, respectively, of the first stirring film 625 and the second stirring film 626 are different from each other in the axial-direction positions.

This allows the second stirring film 626 to transport toner particles, which leak out from gaps between the slits 6251 of the first stirring film 625 and fail to be transported, which in turn improves the power of feeding toner particles. Further, since the thickness of the second stirring film 626 is smaller than the thickness of the first stirring film 625, the rotation power of the stirring axis 64 may not be very large.

Further, since the first stirring film 625 and the second stirring film 626 in cooperation with each other improve the feeding power, this effect decreases to half if a distance (angle) between the first stirring film 625 and the second stirring film 626 is too large. Hence, a mount angle (FIG. 13), at which the first stirring film 625 and the second stirring film 626 are attached axially to the stirring axis 64, is preferably 90 degrees or less (acute angle).

(3-3) Further, while the preferred embodiment described above requires that the edge portion of the lid member 66 of the toner housing portion 300 has a shape projecting from the hollow container 65 (See FIG. 2), this shape is not limiting. Instead however, the shape may be such a shape that is easily set to a retainer, which is used for transportation into a toner filling machine in a production line in a plant, for example.

FIG. 14(*a*) is a perspective view showing an appearance of a retainer 200.

As the retainer 200, in general, a cylindrical retainer with a bottom is used. The toner container 60 is inserted upright into such a retainer 200. The reason for using a cylindrical retainer as the retainer 200 is because if the retainer 200 is rectangular, when the toner container 60 is set to the retainer 200, the direction of the toner container 60 must be changed in accordance with the retainer 200, which is troublesome.

Hence, for easy setting to the retainer 200, as shown in FIG. 14(*b*), portions 601, 602 and 603 of the toner container 60, which are to abut an inner peripheral surface of the retainer 200, are preferably arched.

Further, since this enlarges an abutting area, the toner container 60 is firmly held by the retainer 200.

Still further, the absence of square-like portions does not give a rough feeling to the hands of a user, which makes it easy for the user to handle the structure.

(3-4) Although the rack 33, which moves in the vertical direction as the expose/scan portion 10 opens and closes, is used as a mechanism for rotating the gear 61, which is fixed to the cylindrical member 68 in the preferred embodiment described above, this is not limiting. For example, the mechanism may be a structure in which, when the toner container 60 is set to the top of the developer 50, the gear 61 intermeshes with a gear that is mounted to the driving axis of the electric motor of the apparatus main body. In this case, a set sensor for detecting that the toner container 60 is set and an angle sensor for detecting the angle of revolutions of the cylindrical member 68 may be disposed, so that when the set sensor detects that the toner container 60 is set, rotations of the electric motor is controlled in accordance with angle information which is detected by the angle sensor.

Further, alternatively, for example, such a structure may be used in which the main body comprises a teeth array that intermeshes with the gear 61 as the toner container 60, guided by the guides 41 and 42, is mounted on the developer 50 so that the toner drawing portion 400 is opened and closed in accordance with vertical movement associated with detaching of the container. This allows the omission of the rack 33, the electric motor and the like described above, thereby achieving more simplicity.

(3-5) In addition, the application of the toner container 60 according to the present invention is not limited to such a printer described above. Rather, the toner container 60 according to the present invention is applicable to image creating apparatuses, such as other photocopiers, which comprise a developer apparatus using toner particles and facsimile machines that use plain paper.

As described above, the toner container according to the present invention comprises the lid member, which covers the toner discharge hole from above as the cylindrical member rotates, and therefore, unlike in the conventional method in which the lid member rotates around the outer peripheral surface of the cylindrical member and covers the toner discharge hole from above, no damage is made to the seal member between the lid member and the cylindrical member and hence, no gap is created, which perfectly prevents any leakage of toner particles.

More specifically, the toner container comprises guiding means for guiding the lid member from a first position at which a surface of the lid member, which faces the exterior surface of the cylindrical member of the toner container is off the toner outlet of the toner container, to a second position at which the facing surface of the lid abuts and blocks the toner outlet, and transmitting means for converting circumferential movement of the cylindrical member associated with rotation of the cylindrical member into a direction of movement from the first position to the second position and for transmitting movement to the lid member. Hence, the lid member opens and closes in accordance with the rotation of the cylindrical member.

Further, the top/bottom direction of the toner container is specified in such a manner that the toner outlet of the cylindrical member is directed downward during supply of the toner particles and the lid member blocks the outlet when the cylindrical member is revolved and the toner outlet is positioned to an upper position. This makes it further difficult for the toner particles inside the toner container or cylindrical member to leak out.

Further, at least the surface of the lid member, which is faces cylindrical member and in particular, the toner outlet is formed by an elastic material, and therefore, it is possible to seal off the toner particles inside the cylindrical member and to prevent the leakage of the toner particles from the cylindrical member.

Further, in the toner container, the side surface of the toner container is partially recessed, the opening portion is formed in the recessed surface, and the cylindrical member, which serves as the toner drawing portion, is mounted for free rotation to this portion. As a result, the freedom of design is larger than in the conventional case where the drawing portion projects to the side. Accordingly, the present invention allows the enlargement of the toner housing portion in the projecting direction of the drawing portion. Thus, the toner container has a large capacity.

Further, the toner container comprises a first and a second rotating feed members whose rotation axes are disposed approximately parallel to each other within the toner container; the rotation axis of the first rotating feed member is arranged approximately coaxial with the center of rotation of the cylindrical member so that the first rotating feed member feeds the toner particles toward the outlet when driven, and the second rotating feed member when driven feeds in a different direction from the feeding direction by means of the first feed member at least in a portion of the axial direction. Hence, even when the toner drawing portion is formed as recessing from the side surface of the main body of the toner container, it is possible to transport the toner particles inside to the drawing portion without fail.

Further, since the second rotating feed member is formed by film-like blades, the second rotating feed member transports toner particles while abutting warping against the inner peripheral surface of the toner container. Hence, the shape of the inner peripheral surface is not limited to perfect circle and the freedom of shape improves. In addition, the second rotating feed member is formed with a plurality of blade chains, which are each formed by arranging a plurality of film-like blades in the longitudinal direction of the second rotating feed member, disposed around the axis of the second rotating feed member, and with respect to at least adjacent ones of the blade chains, the positions of blade ends in the axial direction are different from each other. Hence, toner particles slipping from the ends of an early blade chain are transported by the adjacent next blade chain, which improves the power of feeding toner particles.

Further, in an image creating apparatus which develops with toner particles contained in a developer to thereby create an image on an image holder, the toner container is used as a toner container for supplying the toner particles to the developer. Hence, when a user exchanges the toner container and toner particles are transported, the toner particles do not leak out, without obstructing the exchange process and the like.

What is claimed is:

1. A toner container in which a cylindrical member with a toner outlet in an outer periphery portion thereof is attached for free rotation to an opening portion of a toner container main body so that toner particles that are contained in said toner container main body are supplied through said toner outlet of said cylindrical member when the toner outlet is at the bottom of the cylindrical member, said toner container comprising a lid member having a surface that faces the outer periphery of said cylindrical member and that moves toward said cylindrical member for covering said toner outlet when said toner outlet is positioned at the top of the cylindrical member.

2. The toner container of claim 1, wherein said toner container comprises:

guiding means for guiding said lid member from a first position in which said surface of said lid member does not cover said toner outlet to a second position in which said surface of said lid member abuts and blocks said toner outlet; and transmitting means for converting a rotational movement of said cylindrical member associated with a rotation of said cylindrical member into directional movement of said lid member from said first position to said second position.

3. The toner container of claim 1, wherein said cylindrical member is characterized as being opened when said toner outlet is positioned at the bottom of said cylindrical member to permit the flow of toner particles from the toner container, and wherein said cylindrical member is characterized as being closed when said toner outlet is positioned at the top of said cylindrical member beneath said lid member with said lid member blocking said toner outlet.

4. The toner container of any one of claim 1, wherein at least a portion of said surface of said lid member is formed by an elastic material.

5. The toner container of any one of claim 1, wherein a side surface of said toner container is partially recessed, wherein an opening portion is formed in said recessed surface, and wherein said cylindrical member is mounted for free rotation to said opening portion.

6. The toner container of any one of claim 1, wherein said toner container comprises a first rotating feed member and a second rotating feed member whose rotation axes are disposed approximately parallel to each other within said toner container, wherein said rotation axis of said first rotating feed member is arranged approximately coaxial with the center of rotation of said cylindrical member so that said first rotating feed member when driven feeds said toner particles toward said toner outlet, and wherein said second rotating feed member when driven feeds said toner particles in a different direction from the feeding direction of said first rotating feed member at least in a portion of the axial direction.

7. The toner container of claim 6, wherein said second rotating feed member is formed with a plurality of blade chains, which are each formed by arranging a plurality of film-like blades in the longitudinal direction of said second rotating feed member, disposed around the axis of said second rotating feed member, and wherein with respect to at least adjacent ones of said blade chains, the positions of blade ends in the axial direction are different from each other.

8. An image creating apparatus which develops with toner particles contained in a developer to thereby create an image on an image holder, said image creating apparatus including a toner container, said toner container comprising a lid member having a surface that faces the outer periphery of said cylindrical member and that moves toward said cylindrical member for covering said toner outlet when said toner outlet is positioned at the top of the cylindrical member.

9. The toner container of claim 8, wherein said toner container comprises:

guiding means for guiding said lid member from a first position in which said surface of said lid member does not cover said toner outlet to a second position in which said surface of said lid member abuts and blocks said toner outlet; and transmitting means for converting a rotational movement of said cylindrical member associated with a rotation of said cylindrical member into directional movement of said lid member from said first position to said second position.

10. The toner container of claim 8, wherein said cylindrical member is characterized as being opened when said toner outlet is positioned at the bottom of said cylindrical member to permit the flow of toner particles from the toner container, and wherein said cylindrical member is characterized as being closed when said toner outlet is positioned at the top of said cylindrical member beneath said lid member with said lid member blocking said toner outlet.

11. The toner container of any one of claim 8, wherein at least a portion of said surface of said lid member is formed by an elastic material.

12. The toner container of any one of claim 8, wherein a side surface of said toner container is partially recessed, wherein an opening portion is formed in said recessed surface, and wherein said cylindrical member is mounted for free rotation to said opening portion.

13. The toner container of any one of claim 8, wherein said toner container comprises a first rotating feed member and a second rotating feed member whose rotation axes are disposed approximately parallel to each other within said toner container, wherein said rotation axis of said first rotating feed member is arranged approximately coaxial with the center of rotation of said cylindrical member so that said first rotating feed member when driven feeds said toner particles toward said toner outlet, and wherein said second rotating feed member when driven feeds said toner particles in a different direction from the feeding direction of said first rotating feed member at least in a portion of the axial direction.

14. The toner container of claim 13, wherein said second rotating feed member is formed with a plurality of blade chains, which are each formed by arranging a plurality of film-like blades in the longitudinal direction of said second rotating feed member, disposed around the axis of said second rotating feed member, and wherein with respect to at least adjacent ones of said blade chains, the positions of blade ends in the axial direction are different from each other.

15. An Image creating apparatus which develops with toner particles contained in a developer to thereby create an image on an image holder, said image creating apparatus including a toner container, said toner container comprising a lid member having a surface that faces the outer periphery of a cylindrical member and that covers a toner outlet when said toner outlet is positioned at the top of the cylindrical member, wherein said cylindrical member moves to close said toner outlet.

16. A toner container comprising:

a wall portion forming a cavity and storing toner in said cavity;

a rotation portion that forms a part of said wall portion, said rotation portion including a toner outlet opening said cavity, wherein said rotation portion is rotatable so that said toner outlet is capable of turning upward or downward;

and a lid that approaches said toner outlet for covering said toner outlet during rotation of said rotation portion.

17. A toner container comprising:

a holder that holds toner and that has a toner outlet;

a lid that covers said toner outlet;

a moving mechanism that moves said holder; and a closing mechanism that moves said lid to cover said toner outlet.

18. A toner container according to claim 17, wherein said moving of said holder is rotation.

19. A toner container according to claim 18, wherein said lid moves toward central axis of said rotation.

20. A toner container according to claim 17, wherein said closing mechanism is mechanically linked to the moving of said toner holder by said moving mechanism.

* * * * *